US012078021B2

(12) United States Patent
Larsen et al.

(10) Patent No.: US 12,078,021 B2
(45) Date of Patent: Sep. 3, 2024

(54) FISHING JAR

(71) Applicant: INNOVEX DOWNHOLE SOLUTIONS, INC., Houston, TX (US)

(72) Inventors: Adam Larsen, Houston, TX (US); Ronald R. Miller, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 18/158,534

(22) Filed: Jan. 24, 2023

(65) Prior Publication Data

US 2023/0235639 A1 Jul. 27, 2023

Related U.S. Application Data

(60) Provisional application No. 63/302,640, filed on Jan. 25, 2022.

(51) Int. Cl.
*E21B 31/113* (2006.01)

(52) U.S. Cl.
CPC ..... *E21B 31/1135* (2013.01)

(58) Field of Classification Search
CPC ..... E21B 31/1135; E21B 31/113
See application file for complete search history.

(56) References Cited

U.S. PATENT DOCUMENTS 4,494,615 A 1/1985 Jones
4,566,546 A 1/1986 Evans
5,447,196 A 9/1995 Roberts
5,624,001 A * 4/1997 Evans ..... E21B 31/113 166/178
6,290,004 B1 * 9/2001 Evans ..... E21B 31/1135 166/301
6,453,997 B1 9/2002 McNeilly et al.
6,675,909 B1 1/2004 Cowart et al.
2006/0169456 A1 * 8/2006 Evans ..... E21B 31/1135 166/301
2007/0074867 A1 * 4/2007 Chancey ..... E21B 31/1135 166/178
2008/0236894 A1 10/2008 Clausen et al.
(Continued)

OTHER PUBLICATIONS

International Search Report and Written Opinion dated May 11, 2023, PCT Application No. PCT/US2023/061123, 10 pages.

*Primary Examiner* — Shane Bomar
(74) *Attorney, Agent, or Firm* — MH2 TECHNOLOGY LAW GROUP, LLP

(57) ABSTRACT

A fishing jar includes an outer housing, a mandrel positioned at least partially within the outer housing and having a fish end, an anvil coupled to or integral with the mandrel, a hammer coupled to or integral with the outer housing, and a triggering mechanism partitioning a first chamber and a second chamber, the first and second chambers separated axially apart and in fluid communication via the triggering mechanism. The triggering mechanism is configured to permit hydraulic fluid to flow from the first chamber to the second chamber at a first rate in response to pressing the outer housing to move toward the fish end of the mandrel during a downstroke of the outer housing, until the outer housing reaches a trigger position, and then permit the hydraulic fluid to flow from the first chamber to the second chamber at a second rate until the hammer impacts the anvil.

19 Claims, 7 Drawing Sheets

(56) References Cited

U.S. PATENT DOCUMENTS

| | | | | |
|---|---|---|---|---|
| 2009/0266544 | A1* | 10/2009 | Redlinger | E21B 7/068 166/298 |
| 2009/0301707 | A1* | 12/2009 | Budney | E21B 31/1135 166/178 |
| 2011/0297380 | A1* | 12/2011 | Alberty | E21B 31/113 166/301 |
| 2016/0356111 | A1* | 12/2016 | Castillo | E21B 31/107 |
| 2017/0175475 | A1* | 6/2017 | Kartha | E21B 47/12 |
| 2022/0010642 | A1* | 1/2022 | Fairweather | E21B 23/0411 |

* cited by examiner

FISHING JAR

CROSS-REFERENCE TO RELATED APPLICATIONS

This application claims priority to U.S. Provisional Patent Application having Ser. No. 63/302,640, which was filed on Jan. 25, 2022 and is incorporated herein by reference in its entirety.

BACKGROUND

In the oilfield, fishing tools are used to remove other tools, structures, devices, etc., ("fish") from a well. For example, a fish might be part of a drill string that has become stuck during drilling operations or may be production equipment intended to be removed from an existing well during a workover or repair operation. Generally, the fishing tool is connected to a drill string (or any other type of work string), is deployed into the well, and connects to the fish in the well. Once connected to the fish, the fishing tool and the fish are withdrawn from the well by pulling the work string out of the well.

In some situations, a fish can be lodged in the well such that it resists axial movement therein. In such cases, a jar may be employed to generate a shock force to dislodge the fish and permit the fish to be removed from the well. Generally, the jar employs a triggering mechanism that is loaded by setting at least some of the weight down on the fishing tool, which is connected to the fish. This creates potential energy which is stored in the jar and then released rapidly so that a hammer of the jar moves rapidly in an uphole direction and impacts an anvil within the jar. The impact of the hammer on the anvil is transmitted by the fishing tool to the fish. The jar can then be reloaded by again pressing downward on the fishing tool and the process repeated until the fish is free to be pulled from the well.

SUMMARY

Embodiments of the disclosure include a fishing jar including an outer housing that is configured to connect to a work string, a mandrel positioned at least partially within the outer housing and having a fish end configured to engage a fish, the mandrel and the outer housing defining an annulus therebetween, an anvil coupled to or integral with the mandrel, a hammer coupled to or integral with the outer housing, and a triggering mechanism positioned in the annulus so as to partition the annulus into a first chamber and a second chamber, the first and second chambers separated axially apart and in fluid communication via the triggering mechanism, wherein the triggering mechanism is configured to permit hydraulic fluid to flow from the first chamber to the second chamber at a first rate in response to pressing the outer housing to move toward the fish end of the mandrel during a downstroke of the outer housing, until the outer housing reaches a trigger position relative to the mandrel, and permit the hydraulic fluid to flow from the first chamber to the second chamber at a second rate that is greater than the first rate after the outer housing reaches the trigger position until the hammer impacts the anvil at an end of the downstroke.

Embodiments of the disclosure include a fishing assembly including a first fishing jar configured to generate a shock directed in a first direction relative to a fish. The first fishing jar includes an outer housing that is configured to connect to a work string, a mandrel positioned at least partially within the outer housing and having a fish end configured to engage a fish, an anvil coupled to or integral with the mandrel, a hammer coupled to or integral with the outer housing, and a triggering mechanism configured to generate the shock in response to the outer housing being lifted in a second direction that is opposite to the first direction and relative to the mandrel, or to the mandrel being pressed in the first direction relative to the outer housing, and the outer housing being pressed in the first direction relative to the mandrel, and a second fishing jar configured to generate a shock in the second direction relative to the fish.

Embodiments of the disclosure include method for applying a shock to a fish in a well, the method including deploying a fishing jar into proximity of the fish, moving an outer housing of the fishing jar in an uphole direction relative to a mandrel of the fishing jar, the outer housing and the mandrel defining an annulus therebetween, and a triggering mechanism controling a fluid flow between a first chamber of the annulus and a second chamber of the annulus, and pressing the outer housing of the fishing jar, such that the outer housing moves in a downhole direction relative to the mandrel. The triggering mechanism permits hydraulic fluid to move from the first chamber to the second chamber at a first rate until the outer housing reaches a trigger position relative to the mandrel. The triggering mechanism permits the hydraulic fluid to move from the first chamber to the second chamber at a second rate that is higher than the first rate after the outer housing reaches the trigger position, until a hammer of the outer housing impacts an anvil of the mandrel, to generate the shock. A rate of movement of the outer housing relative to the mandrel is proportional to a rate at which the hydraulic fluid flows from the first chamber to the second chamber.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
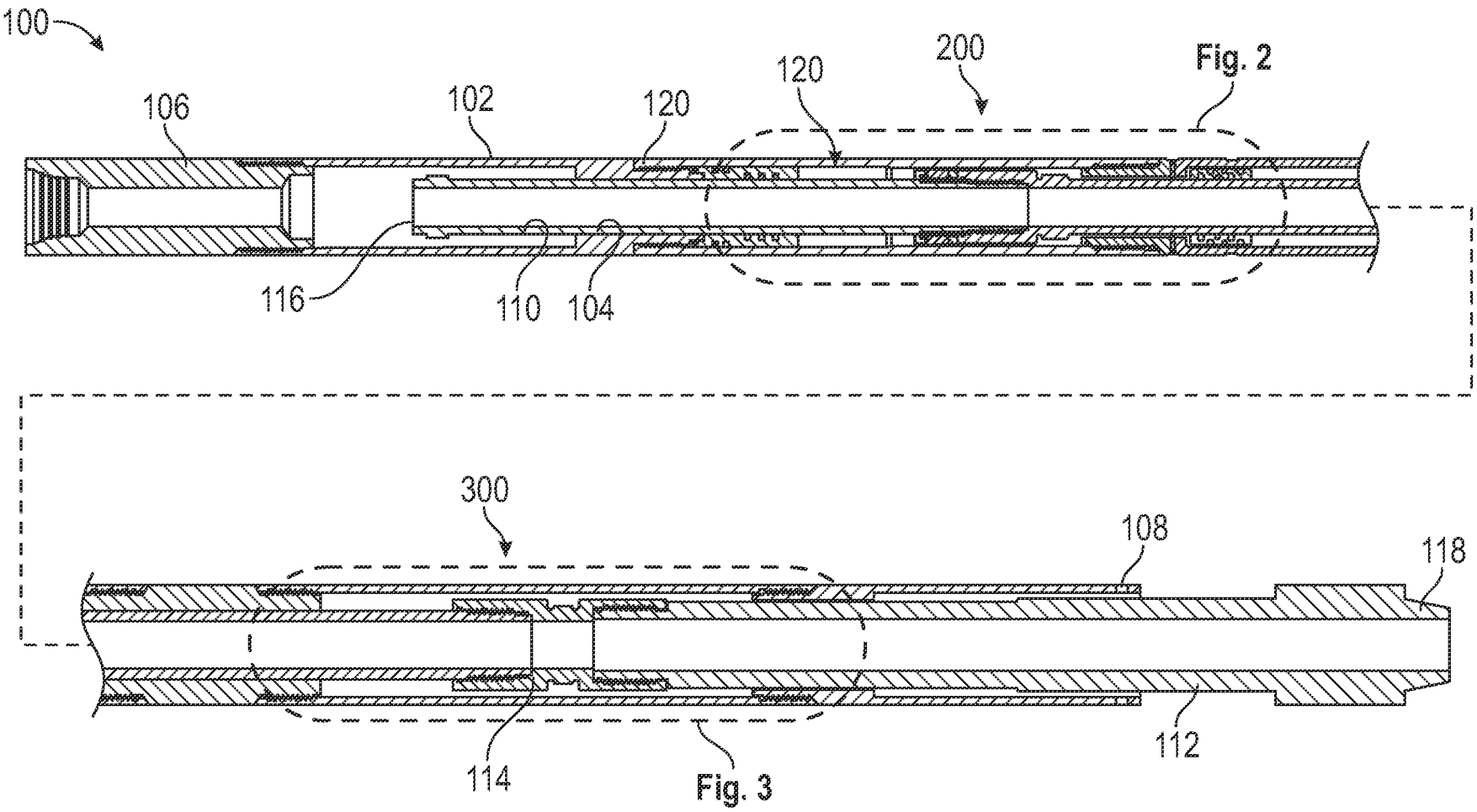
FIG. 1 illustrates a side, cross-sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional side view of a downhole tool 100, according to an embodiment. In an embodiment, the downhole tool 100 may be a fishing jar, which may be configured to connect to a fishing tool and generate shock forces in an effort to dislodge a fish that is stuck in a well. The tool 100 may include an outer housing 102 and a mandrel 104. The mandrel 104 and the outer housing 102 may each be generally cylindrical in shape, with the mandrel 104 being positioned at least partially within the outer housing 102. Further, the outer housing 102 and the mandrel 104 may be movable axially relative to one another, at least over a range of positions. In at least some embodiments, the outer housing 102 and the mandrel 104 may be prevented from sliding apart, as will be described in greater detail below.

An upper sub 106 may be coupled to the outer housing 102. The upper sub 106 may include a threaded (e.g., female or "box") connection for connecting the tool 100 to a superposed structure, e.g., another downhole tool or a work string (e.g., a drill string). The outer housing 102 may include a lower end 108, opposite the upper sub 106, through which the mandrel 104 extends.

The mandrel 104 may include one or more cylindrical members. For example, the mandrel 104 may include an upper mandrel 110 and a lower mandrel 112, which may be connected together, end-to-end, by an intermediate connector 114 and/or one or more intervening mandrels or other structures. The mandrel 104 may include an uphole end 116, which may be positioned proximal to the upper sub 106, but separated axially apart therefrom. The mandrel 104 may also include a lower or "fish" end 118. The lower end 118 may be positioned outside of the outer housing 102 and may include a threaded (e.g., male or "pin") connection. The lower end 118 may be configured to connect to a subjacent tool, e.g., a fishing tool that is configured to connect to a fish.

An annulus 120 may be formed radially between the mandrel 104 and the outer housing 102. A triggering mechanism 200 may be positioned at least partially within the annulus 120. The triggering mechanism 200 may be configured to control a rate of fluid flow between two chambers in the annulus 120, and thereby control a rate of relative movement between the outer housing 102 and the mandrel 104. In at least some embodiments, the triggering mechanism 200 may include part of the outer housing 102 and part of the mandrel 104, as will be described in greater detail below.

The tool 100 may further include an impact mechanism 300 that is at least partially in the annulus 120. The impact mechanism 300, as will be described in greater detail below, may include a pair of stops, one for arresting the uphole (to the left in this view) stroke of the outer housing 102 relative to the mandrel 104, and one providing a hammer and an anvil arrangement for generating the shock by rapidly moving the outer housing 102 in a downhole direction relative to the mandrel 104.

Figure 2:
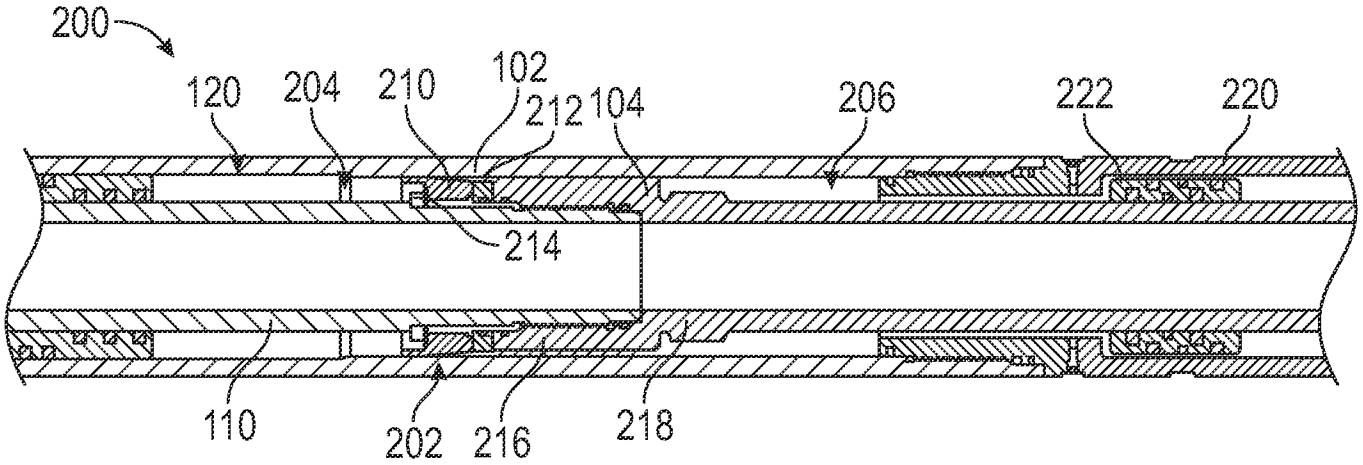
FIG. 2 illustrates a side, cross-sectional view of a portion of the downhole tool, specifically showing a triggering mechanism of the tool, according to an embodiment.

FIG. 2 illustrates an enlarged view of a portion of the tool 100, as indicated in FIG. 1, according to an embodiment. Specifically, FIG. 2 illustrates an example of the triggering mechanism 200. The triggering mechanism 200 includes a metering assembly 202, which controls a flow rate of hydraulic fluid in the annulus 120. In particular, the metering assembly 202 may control fluid flow between a first chamber 204 and a second chamber 206 of the annulus 120.

In a specific embodiment, the metering assembly 202 may include a cone 210, a metering device 212, and a bypass ring 214. The cone 210, the metering device 212, and the bypass ring 214 may reside in the annulus 120, forming a selective barrier to fluid flow between the first and second chambers 204, 206. Further, the cone 210 may be axially adjacent to the metering device 212. At least part of the bypass ring 214 may be radially between an inside diameter surface of the cone 210 and the mandrel 104 (e.g., the upper mandrel 110). The cone 210 may be configured to slide axially along a range of motion, limited by the bypass ring 214, relative to the mandrel 104, e.g., into and out of engagement with the metering device 212. The metering device 212 in turn may be axially adjacent to/engaging an end of a coupling 216 between the upper mandrel 110 and an intermediate mandrel 218 of the mandrel 104.

A float sub 220 may also be connected to or form part of the outer housing 102. The float sub 220 may include a floater piston 222 therein, which may be in fluid communication with the second chamber 206. The floater piston 222 may be configured to slide relative to the outer housing 102 and relative to the mandrel 104, e.g., in response to fluid pressure in the second chamber 206, effectively permitting the second chamber 206 to expand and contract. Accordingly, the floater piston 222 may permit the first and second chambers 204, 206 to remain fluid tight, while permitting the second chamber 206 to expand/contract, e.g., under thermal loads. However, upward pressure in the wellbore may permit the floater piston 222 to press hydraulic fluid into the first chamber 204, e.g., when the pressure in the first chamber 204 drops, as caused by the outer housing 102 moving in an uphole direction and increasing the volume of the first chamber 204.

Figure 3:
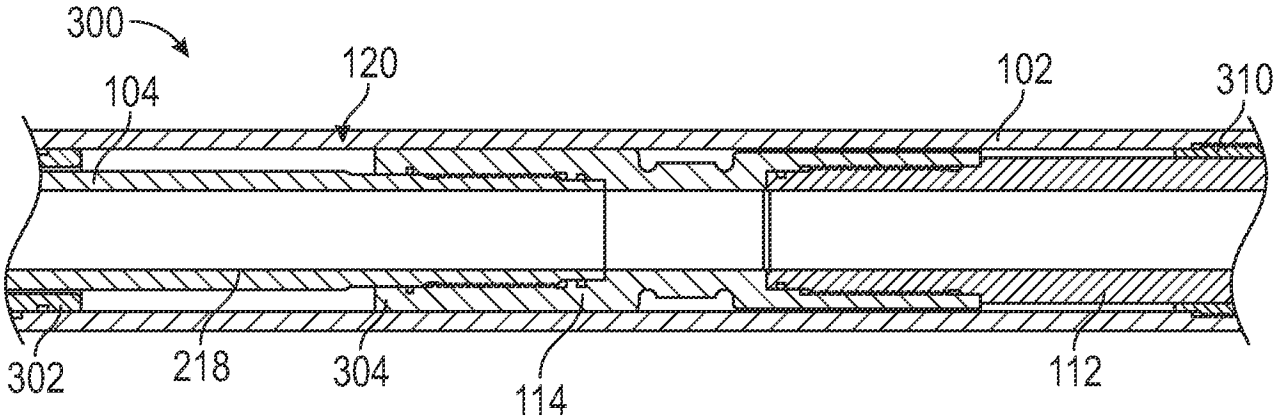
FIG. 3 illustrates a side, cross-sectional view of another portion of the downhole tool, specifically showing an impact mechanism of the tool, according to an embodiment.

FIG. 3 illustrates an enlarged view of another portion of the tool 100, as indicated in FIG. 1, according to an embodiment. Specifically, FIG. 3 illustrates an example of the impact mechanism 300. As shown, the impact mechanism 300 is positioned at least partially in the annulus 120. The impact mechanism 300 may include a hammer 302, which may be integral with or coupled (e.g., threaded) to the outer housing 102 and movable therewith, relative to the mandrel 104. The impact mechanism 300 further includes an anvil 304, which may be integral with or coupled to (e.g., threaded to) the mandrel 104, and may be constrained from movement relative thereto. In a specific embodiment, the anvil 304 is provided the intermediate connector 114 between the intermediate mandrel 218 and the lower mandrel 112. The anvil 304 may thus be immovable relative to the mandrel 104 unless the mandrel 104 is disassembled (in embodiments in which the mandrel is two or more pieces). The hammer 302 may be configured to translate axially, along with the outer housing 102, and relative to the anvil 304, so as to strike the anvil 304 at a bottom (downhole) end of a stroke of the outer housing 102.

The impact mechanism 300 also includes a stroke stop 310. The stroke stop 310 may be coupled to the outer housing 102 or integral therewith, and may be configured to move with the outer housing 102, relative to the mandrel 104. The stroke stop 310 may be configured to engage with the mandrel 104 so as to provide an end-range to uphole directed movement of the outer housing 102 relative to the mandrel 104. In an embodiment, the stroke stop 310 may engage the intermediate connector 114 that provides the anvil 304, but in other embodiments could engage another structure coupled to or forming part of the mandrel 104.

Figure 4:
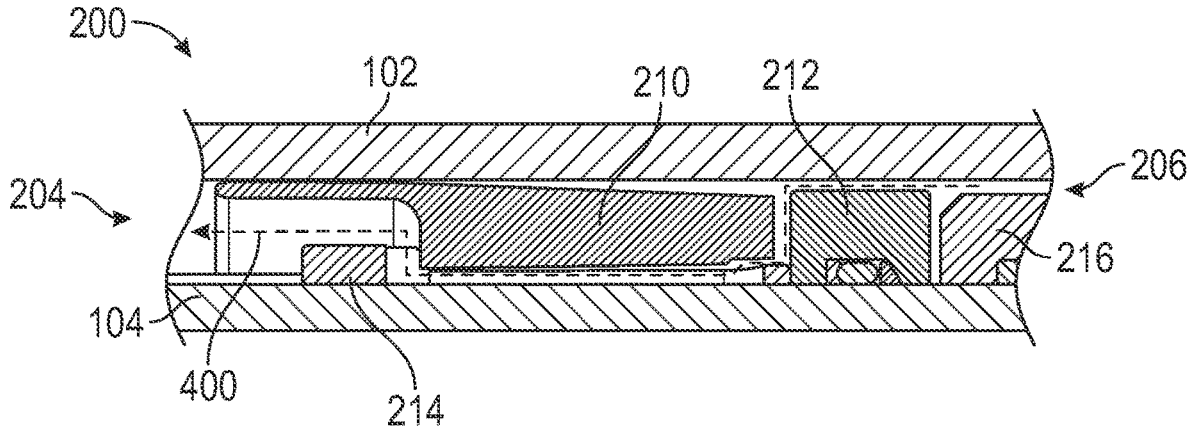
FIG. 4 illustrates a side, cross-sectional view of the triggering mechanism in a first configuration, according to an embodiment.

FIG. 4 illustrates an enlarged view of the triggering mechanism 200 in a first configuration, according to an embodiment. The triggering mechanism 200 may automatically take this configuration during an upstroke of the outer housing 102, e.g., in response to being pulled in an uphole direction by a work string or by pressing the mandrel 104 downhole (either of which may be considered relative movement of the outer housing 102 uphole with respect to the mandrel 104), as will be discussed in greater detail below. In particular, when the outer housing 102 is moved in the uphole direction, i.e., away from the fish end 118 of the mandrel 104, the reduced pressure in the first chamber 204, and the floater piston 222 sealing the second chamber 206, draw the hydraulic fluid from the second chamber 206 to the first chamber 204 via the triggering mechanism 200. This causes the hydraulic fluid to flow around the metering device 212, e.g., radially between the outer diameter thereof and the outer housing 102. The fluid then presses against the cone 210, which responds by moving axially away from engagement with the metering device 212. A radial flowpath is formed between the cone 210 and the metering device 212, which permits the fluid to flow radially inward.

The cone 210 forms a seal with the outer housing 102 in this configuration. In particular, the cone 210 is sized to slidably engage with the outer housing 102, e.g., forming a fluid tight, metal-metal seal with the inner diameter surface of the outer housing 102. The outer housing 102 may include multiple sections having different diameters, which may affect the ability of the cone 210 to seal therewith, as will be discussed below in a third configuration. However, in this first configuration, the cone 210 engages and seals with the outer housing 102, preventing fluid flow from the second chamber 206 to the first chamber 204 radially outward of the cone 210.

As noted above, the bypass ring 214 is radially between the inside diameter surface of the cone 210 and the mandrel 104. The bypass ring 214 is fixed in place relative to the mandrel 104. Likewise, the metering device 212 is fixed in place relative to the mandrel 104. The bypass ring 214 permits the cone 210 to slide along a range of axial positions relative thereto, and thus relative to the metering device 212. Further, the bypass ring 214 permits fluid to flow radially between the cone 210 and the mandrel 104, providing a flowpath for the hydraulic fluid to flow from the second chamber 206 to the first chamber 204, as indicated by arrow 400.

Figure 5:
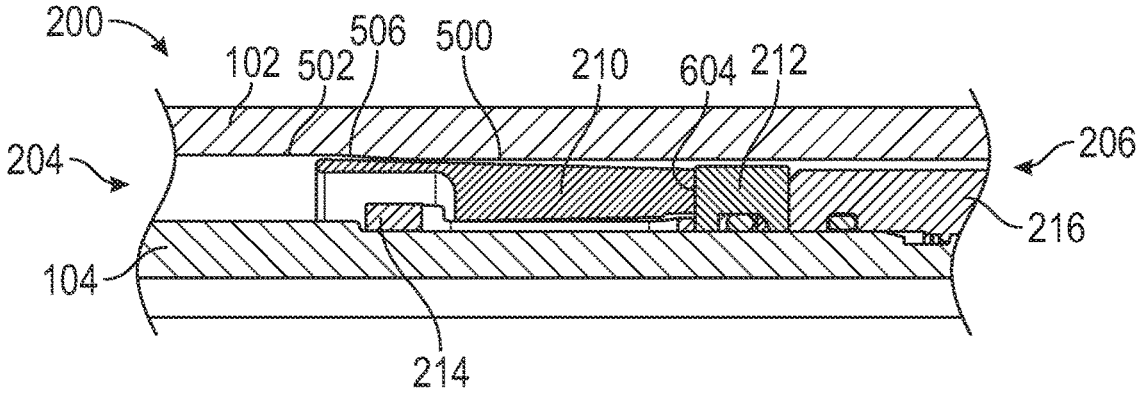
FIG. 5 illustrates a side, cross-sectional view of the triggering mechanism in a second configuration, according to an embodiment.

FIG. 5 illustrates the triggering mechanism 200 in a second configuration, according to an embodiment. In this configuration, the cone 210 has slid in a downhole direction (to the right, in this view), into axial engagement with the metering device 212. This is caused by the outer housing 102 being pressed to move in a downhole direction (to the right in this view) relative to the mandrel 104, e.g., toward the fish end 118 of the mandrel 104. The cone 210 and the metering device 212 may thus form a metal-metal seal therebetween, which at least substantially prevents fluid communication therebetween. Accordingly, fluid is not permitted to flow between the cone 210 and the metering device 212 in a radial direction from radially outside of the metering device 212 to radially inside of the cone 210, or in the reverse radial direction.

In the second configuration, like the first configuration, the cone 210 forms a seal with the outer housing 102. As shown in this view, inner diameter surface of the outer housing 102 includes a first portion 500 and a second portion 502, with the first portion 500 having a smaller diameter than the second portion 502. Further, an upset 506 defines the transition between the first and second portions 502. The cone 210 may sized too small to seal with the second portion 502, and thus, once the upset 506 passes across at least a portion of the cone 210, the seal between the cone 210 and the outer housing 102 may release as the outer housing 102 reaches a "trigger position" relative to the mandrel 104 during the downstroke of the outer housing 102. However, the seal is provided in this second configuration, and the outer housing 102 has not yet reached the trigger position on its downstroke.

Accordingly, with fluid flow prevented around the outside of the cone 210, fluid is forced between the cone 210 and the bypass ring 214 during a first portion of the downstroke of the outer housing 102. This fluid is permitted to flow from the first chamber 204 to the second chamber 206 via a metered flowpath defined in the metering device 212. This metered flow rate may be referred to as a "first" flowrate for the hydraulic fluid flowing from the first chamber 204 to the second chamber 206.

Figure 6:
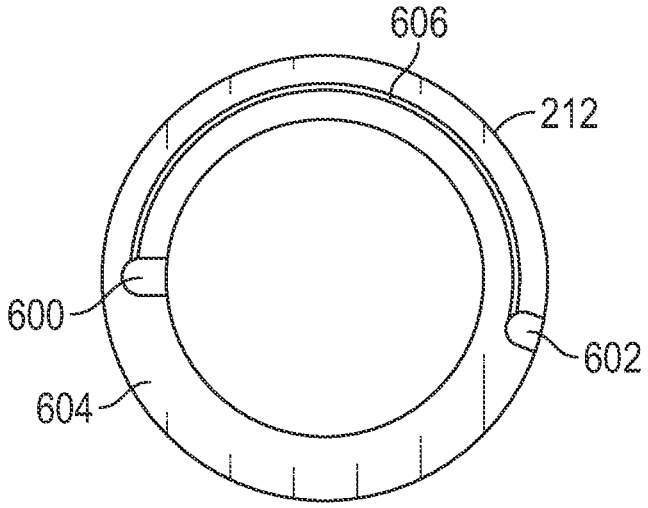
FIG. 6 illustrates an end view of a metering device of the triggering mechanism, according to an embodiment.

FIG. 6 illustrates an end view of the metering device 212, according to an embodiment. As shown, the metering device 212 is generally ring shaped, so as to fit in the annulus 120, e.g., around the mandrel 104 and entrained between the bypass ring 214 and the coupling 216 (FIG. 5). Additionally, the metering device 212 includes an inside port 600 and an outside port 602 formed in a face 604 of the metering device 212. The inside and outside ports 600, 602 are angularly offset from one another. Further, the inside port 600 communicates with and extends from an inner diameter of the metering device 212, while the outside port communicates with and extends from an outer diameter of the metering device 212. An arcuate flowpath 606 is defined in the face 604 between the inside port 600 and the outside port 602.

The face 604 engages the axial end of the cone 210 in the second configuration, at least, as shown in FIG. 5. Thus, referring again to FIG. 5, fluid flows from the first chamber 204, axially past the cone 210 on the radial inside, i.e., between the cone 210 and the mandrel 104 (e.g., via the bypass ring 214), through the arcuate flowpath 606 from the inner diameter of the metering device 212 to the outer diameter thereof, and then past the coupling 216 to the second chamber 206. This flowpath 606 serves to constrain the rate at which the fluid may progress from the first chamber 204 to the second chamber 206. Because the hydraulic fluid may be generally incompressible, this may in turn constrain the rate at which the outer housing 102 may move in the downhole direction (to the right in this view) relative to the mandrel 104.

Figure 7:
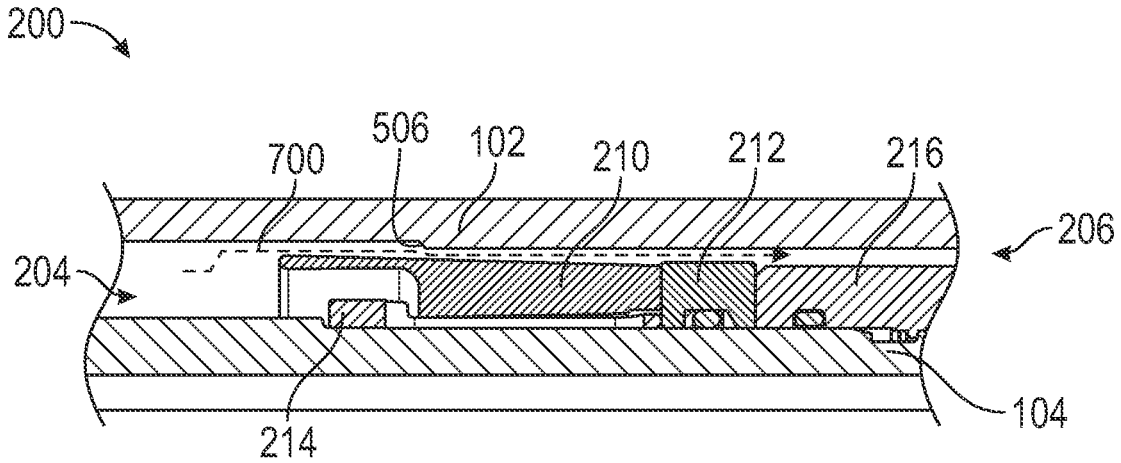
FIG. 7 illustrates a side, cross-sectional view of the triggering mechanism in a third configuration, according to an embodiment.

FIG. 7 illustrates the triggering mechanism 200 in a third configuration, according to an embodiment. As noted above, when the upset 506 passes at least a portion of the cone 210 in the triggering mechanism 200, the cone 210 may disengage from the outer housing 102, permitting fluid flow therebetween. This provides a much larger flowpath past the cone 210, which does not go through the flowpath 606 of the metering device 212, but rather directly across the radial outside of the metering device 212, as indicated by arrow 700.

This permits a much faster movement of hydraulic fluid from the first chamber 204 to the second chamber 206, in comparison to the second configuration, and greatly reduces resistance to movement of the outer housing 102 relative to the mandrel 104 in a downhole direction. In other words, a second rate of hydraulic fluid flow is permitted, which is greater than the first rate permitted by the triggering mechanism 200 in the second configuration. Thus, the upset 506 passing by at least a portion of the cone 210 may be considered the "trigger position" for the outer housing 102 relative to the mandrel 104, as noted above. At this point, a generally constant force pressing downhole on the outer housing 102 may cause the outer housing 102 to accelerate rapidly.

Figure 8:
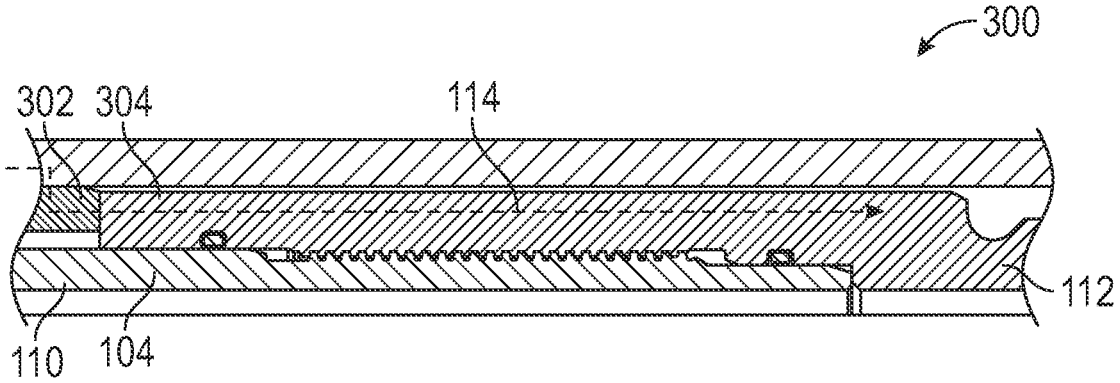
FIG. 8 illustrates a side, cross-sectional view of the impact mechanism, according to an embodiment.

After reaching the trigger position, during the continued, and now more rapidly moving, downstroke of the outer housing 102 and while the triggering mechanism 200 is in the third configuration, the hammer 302 may slide into contact with the anvil 304 at the end of the downstroke. This is illustrated in the side, cross-sectional view of the impact mechanism 300 of FIG. 8. Such contact represents the lower end range for movement of the outer housing 102, and may generate a shock in the mandrel 104 that is transmitted via the fish end 118 (e.g., FIG. 1) to a fish connected thereto, either directly or via one or more intermediate structures.

Figure 9:
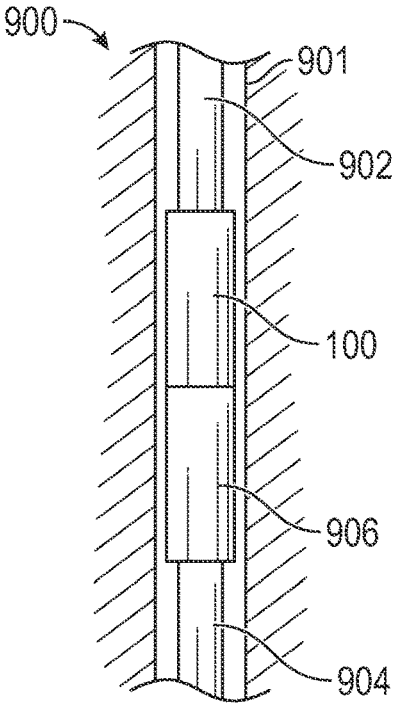
FIG. 9 illustrates a schematic side view of a modular fishing assembly, including the downhole tool, according to an embodiment.

In some embodiments, the tool 100 may be a modular part of a fishing assembly. FIG. 9 illustrates a schematic view of such an assembly 900, according to an embodiment. The assembly 900 may be deployed into a well 901 and may include a work string 902 (e.g., drill string) that extends from a surface of the well 901. The work string 902 may be connected to the tool 100. As discussed above, the tool 100 may be cocked by pulling upwards on the work string 902 (and thus the outer housing 102). In another embodiment, as will be described in greater detail below, the tool 100 may be cocked by pressing the mandrel 104 downward, such that the outer housing 102 moves uphole relative to the mandrel 104 as the mandrel 104 is forced downhole. Once cocked, the work string 902 may be used to press downhole against the outer housing 102, thereby causing the hammer 302 to strike the anvil 304 and develop a shock load.

The tool 100 may be connected directly to a fish 904. In another embodiment, as shown, the tool 100 may be connected to another tool 906, either directly or via one or more intermediate components (lengths of tubular, other tools, etc.). The other tool 906 may be superposed or subjacent with respect to the tool 100, such that either tool 100, 906 may be closer than the other to the fishing tool. As an illustrative example, the other tool 906 is referred to herein as "subjacent", but the foregoing description of other possible configurations remains applicable. In at least some embodiments, the tool 100 and/or the tool 906 may not be connected to the fish 904, but may be set down on the fish 904, e.g., stabbed into or otherwise resting on the fish 904.

The subjacent tool 906 may provide a reverse-action jar, that is, one that includes a hammer that strikes an anvil in response to tension forces applied to the tool 906. In at least some embodiments, the subjacent tool 906 may be structured and/or otherwise configured similarly to the tool 100, but oriented in reverse, such that the cocking and triggering acts in opposition to the cocking and triggering of the tool 100. Thus, for example, cocking the tool 100 may result in triggering the tool 906, and vice versa, providing a bi-directional jar. The relative position of the tool 100 and 906 could be changed, as well, such that the tool 906 is superposed relative to the tool 100, and the tool 100 is directly connected to the fish 904. Thus, the tool 100 may be part of a modular assembly 900 in with the tools 100, 906 can be connected/disconnected and arranged in any order easily (e.g., by rotation of one relative to the other), such that the assembly 900 that can include a single direction jar or bi-directional combination of jars, at the discretion of the operator.

Figure 10:
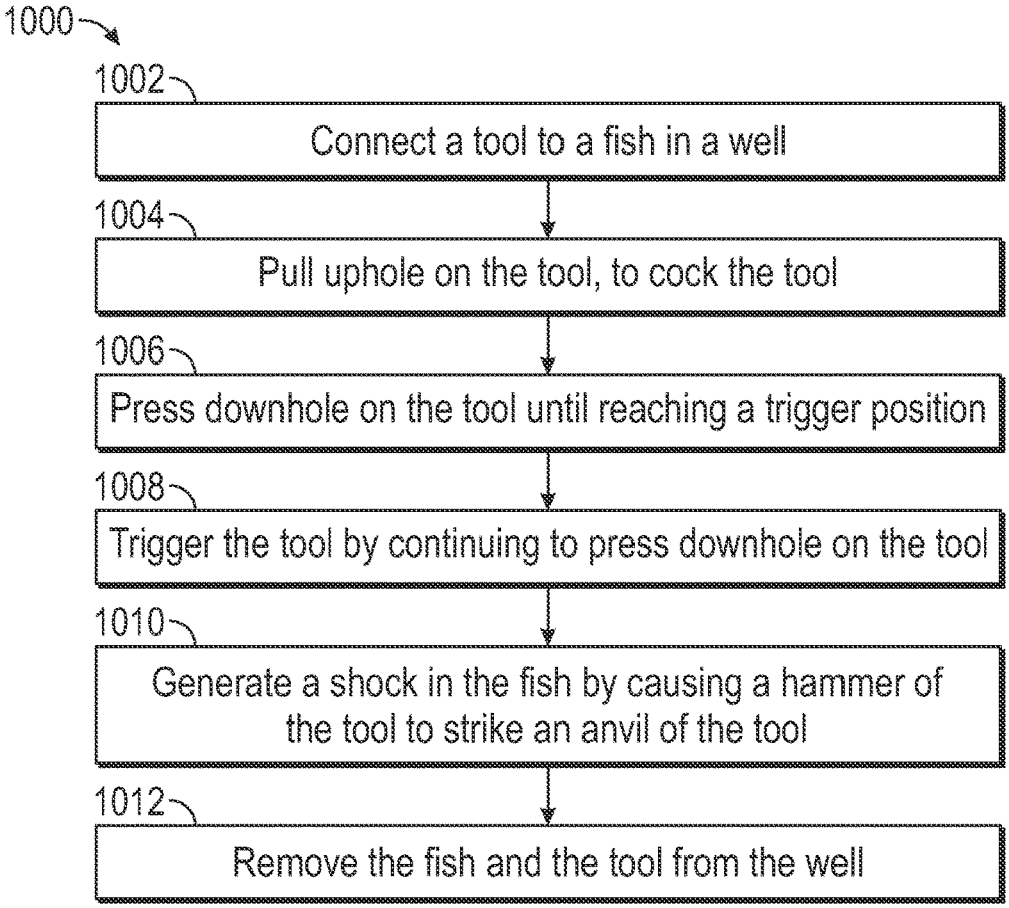
FIG. 10 illustrates a flowchart of a method for well fishing, according to an embodiment.

FIG. 10 illustrates a flowchart of a method 1000 for operating a downhole tool, such as a jar, to dislodge a fish, according to an embodiment. The method 1000 may be executed using an embodiment of the tool 100 (e.g., as part of the assembly 900 of FIG. 9) discussed here, but in other embodiments, may be executed using other tools. The steps of the method 1000 may be performed in the order presented herein, or in another order. Further, the steps may be combined, performed in parallel, or individual steps may be partitioned into two or more discrete steps. The method 1000 will be described herein with reference to several different stages of operation of the tool 100, as depicted sequentially in FIGS. 11A, 11B, 11C, and 11D.

Figure 11A:
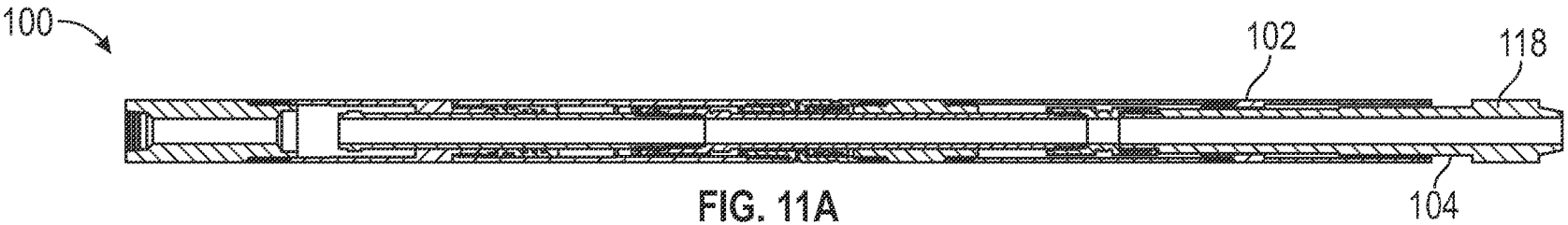
FIGS. 11A, 11B, 11C, and 11D illustrate side, cross-sectional views of the tool in different stages of the method of FIG. 10, according to an embodiment.

Specifically, the method 1000 may include connecting the tool (e.g., tool 100 or 906) with a fish lodged in a well, as at 1002. The mandrel 104 may be connected to the fish, which may prevent the mandrel 104 from moving in the well until the fish is dislodged. For example, the tool 100 may be run into a well using a work string, which may be configured to apply tension and/or compression to the tool 100 so as to move the outer housing 102 thereof. FIG. 11A may represent an initial stage of operation, in which the fish end 118 of the mandrel 104 may be connected to the fish (e.g., via a fishing tool).

Figure 11B:
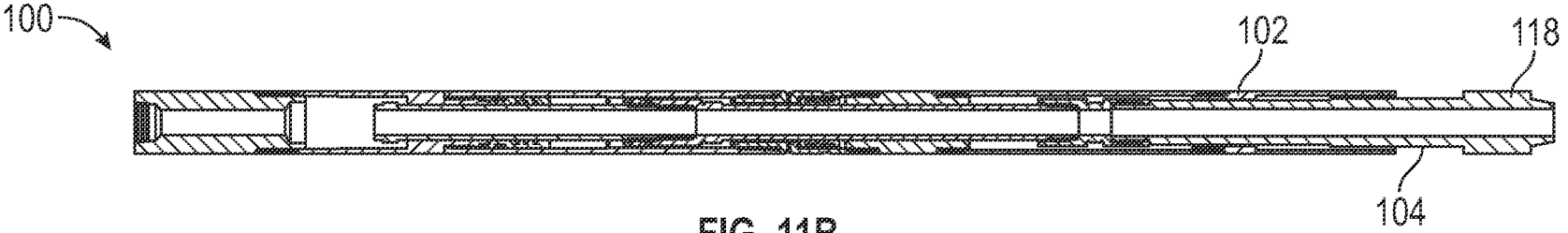

The method 1000 may then include pulling uphole on the tool 100, e.g., applying tension thereto, as at 1004. This may cause the outer housing 102 to move in an uphole direction, away from the fish end 118 of the mandrel 104, as illustrated in FIG. 11B. As noted above with respect to FIG. 4, this may cause fluid to flow from the second chamber 206 to the first chamber 204 of the annulus 120 via the triggering mechanism 200. Eventually the stroke stop 310 may engage the coupling 306 (or another stop device of the mandrel 104), which may prevent further uphole movement of the outer housing 102 relative to the mandrel 104. This may be considered a cocked position for the tool 100, but in other embodiments, the tool 100 may be considered cocked prior to the stroke stop 310 engaging the coupling 306 (or other stop device).

Figure 11C:
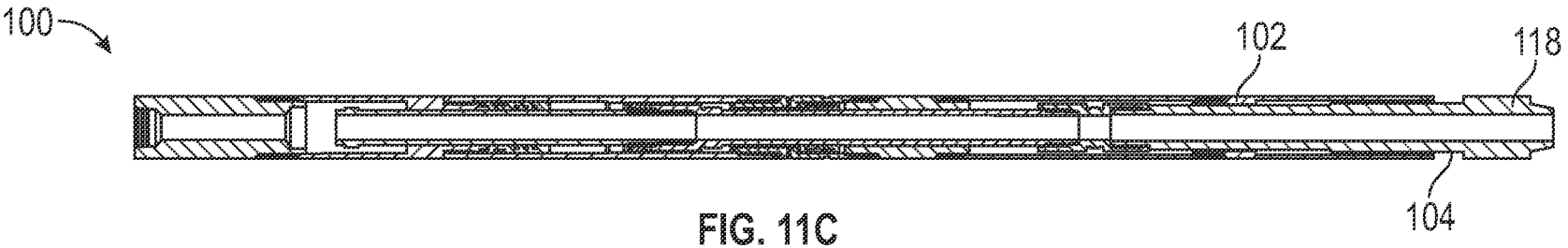

The method 1000 may then include pressing downhole on the tool 100, e.g., applying a compressive load to the tool 100, as at 1006. This may cause the outer housing 102 to move in a downhole direction, toward the fish end 118 of the mandrel 104. This is illustrated in FIG. 11C. Further, as discussed above with reference to FIG. 5, the triggering mechanism 200 may initially be in the second configuration, with the cone 210 sealing with the outer housing 102. To permit movement of the outer housing 102 in the downhole direction, the hydraulic fluid flows from the first chamber 204 to the second chamber 206 via the triggering mechanism 200. The triggering mechanism 200 in the second configuration, however, directs fluid flow through the flowpath 806 (FIG. 8) of the metering device 812, which slows fluid flow. Because the fluid flow is slowed, the movement of the outer housing 102 is constrained to a first rate, which may be relatively slow.

The method 1000 also includes triggering the tool 100 by continuing to press the tool 100 in the downhole direction, as at 1008. As discussed above with respect to FIG. 7, eventually the upset 506 passes at least partially by the cone 210. The cone 210 thus moves from the first portion 500 of the inner surface of the outer housing 102 to the second portion 502 thereof, where the cone 210 no longer engages the inner surface. Fluid is thus permitted to flow directly past the cone 210 and the metering device 212, without flowing through the flowpath 806. As a consequence, the rate of fluid flow abruptly increases from the first rate to a higher second rate, assuming the compressive force remains generally constant. Accordingly, the outer housing 102 quickly accelerates in the downhole direction relative to the mandrel 104.

Figure 11D:
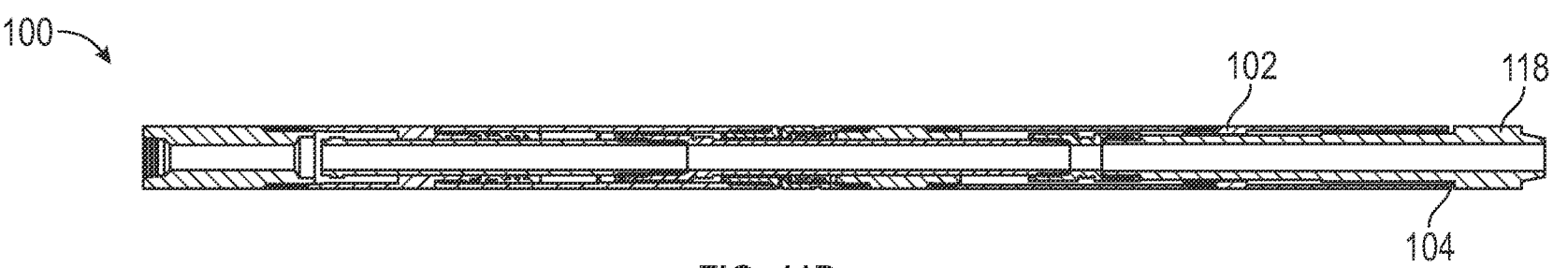

The method 1000 may then include generate a shock in the fish by causing the hammer 302 to strike the anvil 304, as at 1010. This is generally illustrated in FIG. 11D. As discussed above, this may be the end of the downstroke of the outer housing 102. This shock may be transmitted via the mandrel 104 to the fish, e.g., via one or more other components, in an effort to dislodge the fish from the well. Once the fish is dislodged, the method 1000 may include removing the fish and the tool 100 connected thereto from the well, as at 1012.

In some embodiments, the tool 100 may be used as part of a modular assembly 900 including at least one other tool 906, as shown in and discussed above with reference to FIG. 9. Accordingly, in at least one embodiment of the method 1000, pulling upwards at 1002 may trigger the other tool 906 to create an uphole-directed shock, and pressing downwards at 1004-1006 may cock the other tool 906. Further, in at least some embodiments, the method 1000 may include assembling and/or disassembling the tool 100 with the tool 906 to form the modular assembly 900, e.g., by connecting together the different components, e.g., directly or via one or more intermediate components.

Figure 12:
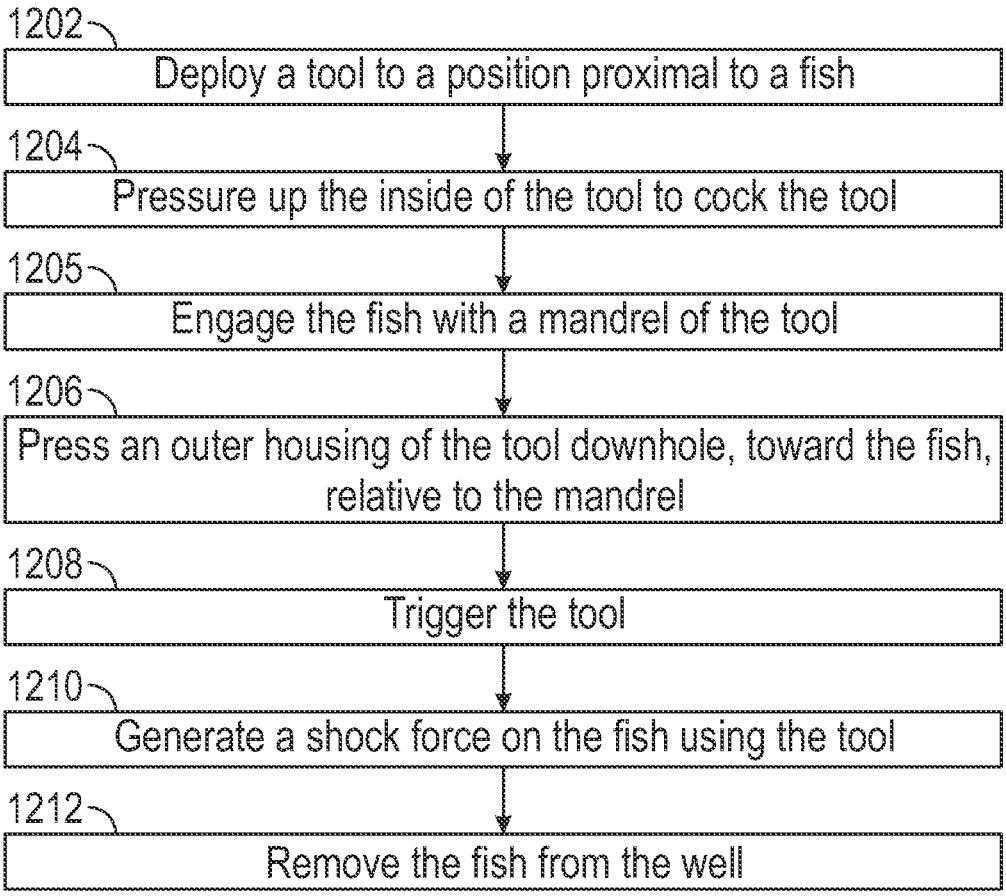
FIG. 12 illustrates a flowchart of another method for well fishing, according to an embodiment.

FIG. 12 illustrates a flowchart of another method 1200, according to an embodiment. The method 1200 of FIG. 12 may be similar to the method 1000 of FIG. 10, except, e.g., that the mandrel 104 may not be connected to the fish in the wellbore; rather, fluid pressure within the tool (e.g., fishing jar) 100 may stroke the mandrel 104 relative to the outer housing 102, thereby preparing the tool 100 for triggering. Reference is again made to FIGS. 11A-D, which illustrate the sequence of the method 1200. It will be appreciated, however, that the steps of the method 1200 may be performed in the order presented, or in any other order. Further, certain steps may be combined or partitioned into two or more steps, performed in parallel, etc., without departing from the scope of the present disclosure.

In the illustrated embodiment, the method 1200 may include deploying the tool 100 to a position that is proximal to a fish, as at 1202. In some embodiments, the mandrel 104 (or a fishing tool connected thereto) may land on the fish, but in other embodiments, the mandrel 104 may be deployed to a position that is not to the fish.

The method 1200 may then include increasing a pressure within the tool 100 to stroke the mandrel 104 downhole and/or the outer housing 102 uphole, so as to move the tool 100 into the second configuration, as at 1204. That is, the tool 100 is moved into the configuration shown in FIG. 11B without relying on pulling against a stuck fish.

For example, referring to FIG. 1, the inner bore of the tool 100 may be blocked, such that fluid is not free to flow out of the mandrel 104. Rather, fluid flows into the tool 100 and enters the mandrel 104 via the uphole end 116, and the lower end of the mandrel 104 may be blocked (e.g., by a valve, a bridge, a fishing tool, or any other structure, whether connected to the mandrel 104 or separate). Thus, the uphole end 116, which extends above the triggering mechanism 200 may have an axially-facing surface area, and the pressure may be exerted upon this surface area. Further, the geometry of the mandrel 104 proximal to the uphole end 116 may be selected such that the surfaces facing axially uphole are larger than the surfaces facing axially downhole. Since force is pressure times surface area, and the pressure is constant, the larger surface area of the axial-uphole face surface results in a net downhole force on the mandrel 104. This net downhole force is sufficient to press the mandrel 104 downwards and lift the outer housing 102. In some embodiments, the outer housing 102 could also or instead provide a surface area differential that results in fluid pressure forcing the outer housing 102 upwards relative to the mandrel 104.

Accordingly, by pressuring up the interior of the outer housing 102, the mandrel 104 extends in a downhole direction relative to the outer housing 102, and the tool 100 moves into the second configuration of FIG. 11B, without connecting the mandrel 104 to the fish. In some embodiments, the mandrel 104 may be withdrawn from connection with the fish prior to pressuring up, or may not land on the fish prior to moving into the second configuration.

The mandrel 104 may then be engaged with the fish, whether in continuation of a prior engagement or by moving the tool 100 in the second configuration downhole until the fish end 118 of the mandrel 104 lands on the fish, as at 1205. In an embodiment, the method 1200 may then include pressing downhole on the tool 100, e.g., applying a compressive load to the tool 100, as at 1206. This may cause the outer housing 102 to move in a downhole direction, toward the fish end 118 of the mandrel 104. This is illustrated in FIG. 11C. As noted above, during this movement, the fluid flow between the chambers 204, 206 is constrained, resulting in relatively slow movement of the outer housing 102 downward along the mandrel 104.

The method 1200 also includes triggering the tool 100, e.g., by continuing to press the tool 100 in the downhole direction, as at 1208. As discussed above, once the tool 100 is triggered, the rate of fluid flow between the first and second chambers 204, 206 abruptly increases. Accordingly, the outer housing 102 quickly accelerates in the downhole direction relative to the mandrel 104.

The method 1200 may then include generating a shock in the fish by causing the hammer 302 to strike the anvil 304, as at 1210. This is generally illustrated in FIG. 11D. As discussed above, this may be accomplished by continuing to press downward on the tool 100 until abruptly reaching the end of the downstroke of the outer housing 102. This shock may be transmitted via the mandrel 104 to the fish, e.g., via one or more other components, in an effort to dislodge the fish from the well. Once the fish is dislodged, the method 1200 may include removing the fish and the tool 100 connected thereto from the well, as at 1212.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A fishing jar, comprising:

an outer housing that is configured to connect to a work string;

a mandrel positioned at least partially within the outer housing and having a fish end configured to engage a fish, the mandrel and the outer housing defining an annulus therebetween;

an anvil coupled to or integral with the mandrel;

a hammer coupled to or integral with the outer housing; and a triggering mechanism positioned in the annulus so as to partition the annulus into a first chamber and a second chamber, the first and second chambers separated axially apart and in fluid communication via the triggering mechanism, wherein the triggering mechanism is configured to:

permit hydraulic fluid to flow from the first chamber to the second chamber at a first rate in response to pressing the outer housing to move toward the fish end of the mandrel during a downstroke of the outer housing, until the outer housing reaches a trigger position relative to the mandrel; and permit the hydraulic fluid to flow from the first chamber to the second chamber at a second rate that is greater than the first rate after the outer housing reaches the trigger position until the hammer impacts the anvil at an end of the downstroke.

2. The fishing jar of claim 1, wherein a force pressing the outer housing to move toward the fish end of the mandrel is substantially constant before and after the outer housing reaches the trigger position during the downstroke.

3. The fishing jar of claim 1, wherein the triggering mechanism is configured to permit the hydraulic fluid to flow from the second chamber to the first chamber in response to an uphole-directed cocking force that moves the outer housing away from the fish end of the mandrel.

4. The fishing jar of claim 3, wherein the mandrel defines an axial surface area that is greater in an uphole orientation than a downhole orientation, such that a pressure in the outer housing generates the cocking force, which presses the mandrel in a downhole direction.

5. The fishing jar of claim 3, wherein the mandrel is connected to the fish, and wherein the cocking force is applied by lifting uphole on the outer housing.

6. The fishing jar of claim 1, wherein the outer housing has an inner surface that faces the mandrel, the inner surface defining a first portion having a first diameter, a second portion having a second diameter, and an upset defining a transition between the first and second portions, and wherein the triggering mechanism comprises a cone sized to form a seal with the inner surface of the outer housing in the first portion and sized to not form a seal with the inner surface of the outer housing in the second portion.

7. The fishing jar of claim 6, wherein the upset passes by at least a portion of the cone for the outer housing to reach the trigger position.

8. The fishing jar of claim 6, further comprising a metering device, the metering device being positioned in the annulus between the first and second chambers and configured to permit fluid to flow at the first rate from an inner diameter of the metering device to an outer diameter of the metering device.

9. The fishing jar of claim 8, further comprising a bypass ring positioned at least partially radially inward of the cone, the bypass ring configured to permit fluid to flow past an inner diameter surface of the cone, through a flowpath defined at least partially radially between the bypass ring and the cone.

10. The fishing jar of claim 9, wherein the cone is configured to axially engage the metering device in response to the outer housing moving toward the fish end of the mandrel, wherein fluid flow in a radial direction, axially between the cone and the metering device is prevented while the cone axially engages the metering device.

11. The fishing jar of claim 10, wherein the cone is configured to be axially spaced apart from the metering device in response to the outer housing being moved away from the fish end of the mandrel, wherein fluid flow is permitted in a radial direction, axially between the cone and the metering device when the cone is spaced apart from the metering device.

12. The fishing jar of claim 9, wherein the hydraulic fluid flowing from the second chamber to the first chamber at the second rate flows radially outward of the cone and the metering device.

13. A fishing assembly, comprising:

a first fishing jar configured to generate a shock directed in a first direction relative to a fish, wherein the first fishing jar comprises:

an outer housing that is configured to connect to a work string;

a mandrel positioned at least partially within the outer housing and having a fish end configured to engage a fish;

an anvil coupled to or integral with the mandrel;

a hammer coupled to or integral with the outer housing; and a triggering mechanism configured to generate the shock in response to:

the outer housing being lifted in a second direction that is opposite to the first direction and relative to the mandrel, or to the mandrel being pressed in the first direction relative to the outer housing, and the outer housing being pressed in the first direction relative to the mandrel; and a second fishing jar configured to generate a shock in the second direction relative to the fish, wherein the first fishing jar and the second fishing jar are each connectable to a work string, to another of the first or second fishing jar, such that the first and second fishing jars are modular.

14. The assembly of claim 13, wherein the first fishing jar, the second fishing jar, or both are configured to connect to the fish.

15. A method for applying a shock to a fish in a well, comprising:

deploying a fishing jar into proximity of the fish;

moving an outer housing of the fishing jar in an uphole direction relative to a mandrel of the fishing jar, wherein the outer housing and the mandrel define an annulus therebetween, and wherein a triggering mechanism controls a fluid flow between a first chamber of the annulus and a second chamber of the annulus; and pressing the outer housing of the fishing jar, such that the outer housing moves in a downhole direction relative to the mandrel, wherein the triggering mechanism permits hydraulic fluid to move from the first chamber to the second chamber at a first rate until the outer housing reaches a trigger position relative to the mandrel, wherein the triggering mechanism permits the hydraulic fluid to move from the first chamber to the second chamber at a second rate that is higher than the first rate after the outer housing reaches the trigger position, until a hammer of the outer housing impacts an anvil of the mandrel, to generate the shock, and wherein a rate of movement of the outer housing relative to the mandrel is proportional to a rate at which the hydraulic fluid flows from the first chamber to the second chamber.

16. The method of claim 15, further comprising connecting the mandrel to the fish prior to moving the outer housing in the uphole direction, wherein moving the outer housing in the uphole direction comprises lifting the outer housing in the uphole direction while the mandrel is connected to the fish.

17. The method of claim 15, wherein moving the outer housing in the uphole direction relative to the mandrel comprises:

increasing a pressure within the outer housing, such that a downhole directed force is applied to the mandrel, wherein the downhole directed force drives the mandrel downhole and causes the outer housing to move in the uphole direction relative thereto.

18. The method of claim 17, further comprising engaging the mandrel with the fish after increasing the pressure and before pressing the outer housing of the fishing jar such that the mandrel transmits the shock to the fish.

19. The method of claim 17, wherein the mandrel is not connected with the fish while moving the outer housing in the uphole direction relative to the mandrel.

* * * * *